US005671533A

United States Patent [19]

Dillamore et al.

[11] Patent Number: 5,671,533

[45] Date of Patent: Sep. 30, 1997

[54] MANUFACTURE OF FORGED COMPONENTS

[75] Inventors: Ian Leslie Dillamore, West Midlands; Eric Grundy; Robert Anthony Yeardley, both of Leeds, all of England

[73] Assignee: Doncaster plc, England

[21] Appl. No.: 498,388

[22] Filed: Jul. 5, 1995

[30] Foreign Application Priority Data

Jul. 6, 1994 [GB] United Kingdom ..... 9413631

[51] Int. Cl.[6] ..... B23P 15/00

[52] U.S. Cl. ..... 29/889.7; 29/889; 29/527.6

[58] Field of Search ..... 29/889.7, 527.6, 29/889, 889.2, 889.6, 527.5; 164/129

[56] References Cited

U.S. PATENT DOCUMENTS

| | | | |
|---|---|---|---|
| 3,205,570 | 9/1965 | Morin | 29/527.6 |
| 3,445,904 | 5/1969 | Harrison et al. | 29/527.6 |
| 4,030,944 | 6/1977 | Sommer et al. . . | |
| 4,034,955 | 7/1977 | Wallace . | |
| 4,043,023 | 8/1977 | Lombard | 164/76 |
| 5,101,547 | 4/1992 | Tamaka et al. . | |
| 5,299,353 | 4/1994 | Nazmy et al. | 29/889.7 |

FOREIGN PATENT DOCUMENTS

| | | |
|---|---|---|
| 0 320 729 | 12/1988 | European Pat. Off. . |
| 0 443 544 | 8/1991 | European Pat. Off. . |
| 769950 | 3/1957 | United Kingdom . |
| 1 269 248 | 4/1972 | United Kingdom . |
| 1 364 235 | 8/1974 | United Kingdom . |
| 1 393 989 | 5/1975 | United Kingdom . |
| 2 067 939 | 8/1981 | United Kingdom . |
| 2 264 719 | 9/1993 | United Kingdom . |
| 88/01546 | 3/1988 | WIPO . |

OTHER PUBLICATIONS

Japanese Abstract, JP 62267052 A (Kobe Steel), vol. 12, No. 145, pp. 76.

*Primary Examiner*—Irene Cuda
*Attorney, Agent, or Firm*—Larson and Taylor

[57] ABSTRACT

A method and apparatus for centrifugal casting a blank separable into a plurality of preforms having a required configuration for forging to a finished component. Individual molds are symmetrically located around the axis of rotation of a casting table and have mold cavities that are filled by molten alloy under the centrifugal force created by rapidly rotating the table. Alternatively, a cylindrical mold is centered on the axis of rotation and the centrifugal force created by rapidly rotating the table causes the molten alloy to fill cavities in the wall of the mold. Centrifugal forces of at least 20 g may be employed.

20 Claims, 4 Drawing Sheets

MANUFACTURE OF FORGED COMPONENTS

BACKGROUND OF THE INVENTION

This invention relates to the manufacture of forged components. The invention has particular application to forged metallic components, especially, but not exclusively components of titanium alloy required in small batch quantities, For example, airfoils for use in the compressors of aero-engines and industrial gas-turbines where properties such as tensile and creep ductility and fatigue life are especially important, and other parts of complex shape such as medical prostheses and pipe fittings.

Conventionally, components of titanium alloy are forged from a preform having a cross-section close to that of the finished component. Typically, the preform is made by hot working bar obtained from a cast ingot of titanium alloy.

This route of hot working from ingot to preform and finish forging ensures that any porosity in the cast ingot does not persist into the finished component, Thus, any non-metallic inclusions in the cast ingot are broken down by hot working the ingot to bar and are strung out along the bar axis. This distribution is retained in the forged component and has minimal adverse effect on properties. In addition, the segregated structure of the cast ingot is homogenised to a uniform composition having the required properties by hot working the ingot to bar. These properties are preserved and reproduced in the forged component.

Several stages of hot working are required to transform the bar to the preform shape required for finish forging. This adds to manufacturing costs and entails many subsidiary processes such as application and removal of lubricating and protective coatings, heating and flash removal requiring long production times and substantial inventories of work in progress. In addition, the design of intermediate preforms and tooling requires considerable experience and knowledge of material limitations, metal flow, die behaviour etc. and requires investment in a variety of presses for hot working different preforms for different forgings which adds further to manufacturing costs.

It is an object of the present invention to provide a method of manufacturing a forged metallic component from a preform in which the aforementioned problems and disadvantages of hot working bar obtained from a cast ingot are substantially avoided whereby manufacturing costs may be reduced.

SUMMARY OF THE INVENTION

According to one aspect of the present invention a method of manufacturing a forged metallic component such as an airfoil for the compressor of an aero engine or industrial gas turbine comprises centrifugal casting a blank for one or more preforms having a required configuration for forging to a desired component, and forging the preform obtained from the blank to produce the component.

We have found that castings with a uniform and, by casting standards, fine grain size free from unacceptable levels of porosity can be produced by the invented method. Suitable castings can be obtained by rapidly rotating a casting table to fill either cavities in individual moulds symmetrically located around the table or cavities in a cylindrical mould centred on the table.

Whichever method is used, it is possible to determine the combinations of distance of the cavities from the rotational axis of the table and the rotational speed of the table to attain the desired centrifugal force for producing satisfactory castings. In general, a centrifugal force of at least 20 g may be required and preferably at least 30 g and more preferably 50 g or higher.

The Invention combines the advantages of finish forging a preform to obtain the desired properties of tensile and creep ductility and fatigue life with casting as a route to obtain the preform with the required configuration for forging.

In this way, manufacturing costs are reduced by avoiding the long and expensive sequence of stages to produce the preform by the conventional route of hot working metallic bar without any significant adverse effect on the properties of the forged component.

A further feature of the Invention is that cast preforms for finish forging can be obtained from cheaper starting materials than preforms obtained by the conventional route providing a further reduction in manufacturing costs without any significant adverse affect on the properties of the forged component. For example, starting materials for cast titanium alloy preforms include an electrode welded from large pieces of titanium alloy scrap or an electrode single melted from compacted titanium sponge and alloying elements with the necessary homogenisation being achieved on remelting the electrode to cast the preform whereas the conventional route requires bar hot worked from double vac-arc melted titanium ingot.

According to another aspect of the invention there is provided a method of casting a blank for one or more pre-forms having a required configuration for forging in the production of a desired metallic component comprises providing a mould having a cavity corresponding to the configuration of the blank, feeding molten alloy to the mould whilst rotating the mould about an axis of rotation to generate a centrifugal force sufficient for the alloy to fill the cavity, cooling the alloy to solidify the alloy, and removing the cast blank from the cavity.

Advantageously, the mould is positioned so that the cavity fills in a direction towards the axis of rotation. In this way, any residual porosity in the casting is forced towards the surface nearest the axis of rotation and can be removed prior to forging. A centrifugal force of at least 20 g is often sufficient to produce satisfactory castings although higher pressures created by a centrifugal force of least 30 g or even 50 g may be beneficial for some configurations of casting.

To obtain cast preforms free from unacceptable levels of porosity and contamination, it is preferred to cast the molten alloy rapidly under pressure in vacuum with low superheat and avoiding contact with surfaces that react with the alloy. Permanent moulds which can be re-used to produce a multiplicity of blanks are preferred and suitable materials for casting titanium alloy blanks include steel and block graphite which have a high heat capacity and thermal conductivity with sufficient strength to resist distortion at moderate temperatures and no reaction with titanium.

According to yet another aspect of the invention there is provided a cast blank for the production of one or more, preforms having a required configuration for forging to a finished component wherein the blank is obtained by centrifugal casting.

We have found that components can be forged from cast preforms obtained from a blank produced by centrifugal casting without any significant adverse effect on properties as compared with components forged from preforms obtained from hot worked bar. In particular, a forged reduction of approximately 50% or more of the section of the cast preform can produce acceptable properties without any subsequent heat treatment of the forged component. Nevertheless, heat treatment of components forged from cast preforms may be used to obtain a microstructure similar to that of components forged from hot worked preforms.

Other preferred features, benefits and advantages of the invention will be apparent from the following description of exemplary embodiments with reference to the accompanying drawings.

DETAILED DESCRIPTION OF THE EXEMPLARY EMBODIMENTS

Figure 1:
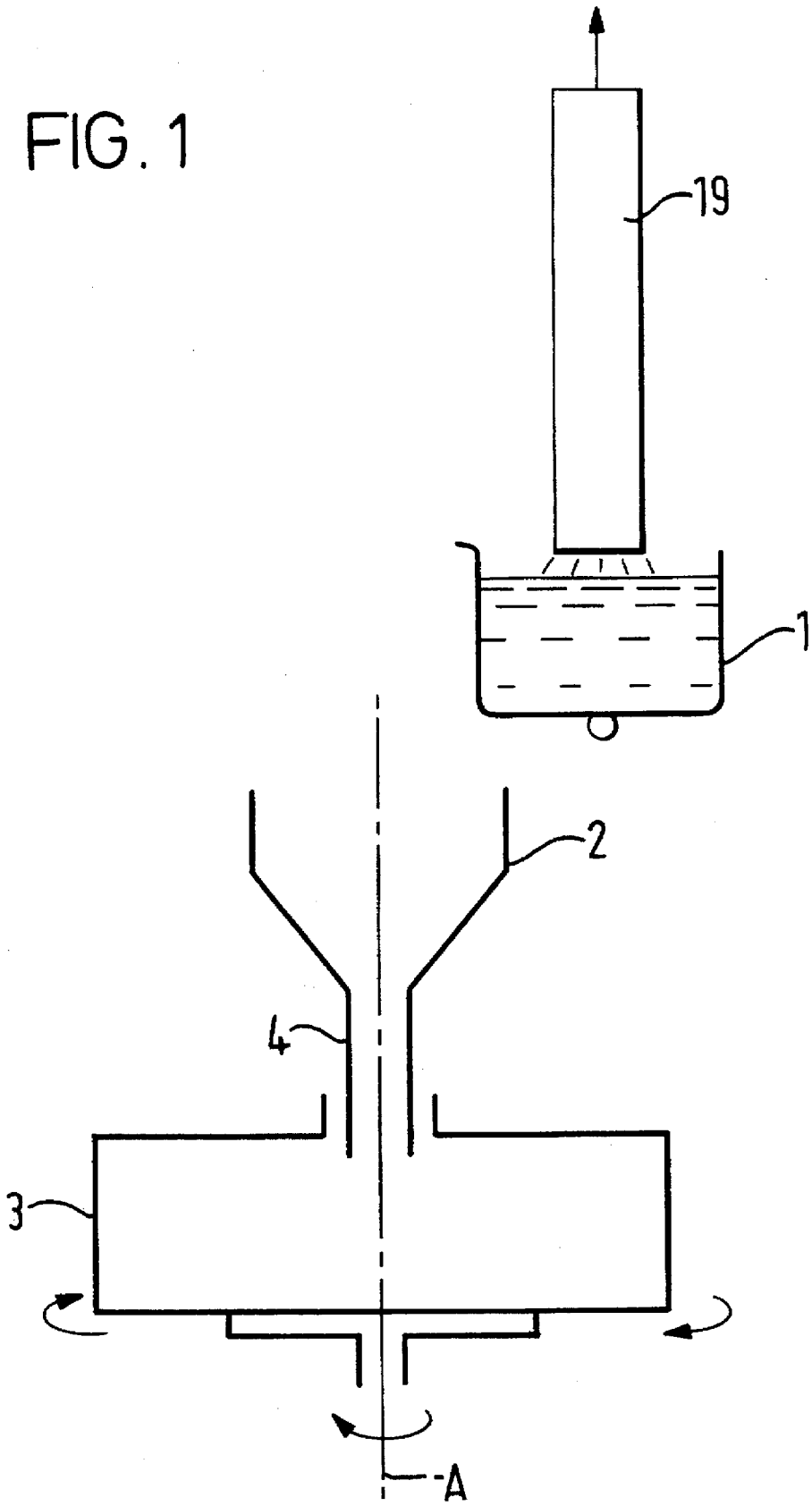
FIG. 1 shows schematically the general lay-out of apparatus for casting molten titanium alloy in a rotating mould according to the method of the present invention.

Referring first to FIG. 1, apparatus for casting titanium alloy under vacuum to prevent reaction with atmospheric oxygen and nitrogen generally comprises a water cooled copper crucible I for skull melting a titanium alloy electrode 19 and pouring the alloy through an outlet 4 of a tundish 2 into a casting table 3 rotatable about an axis A.

Figure 2:
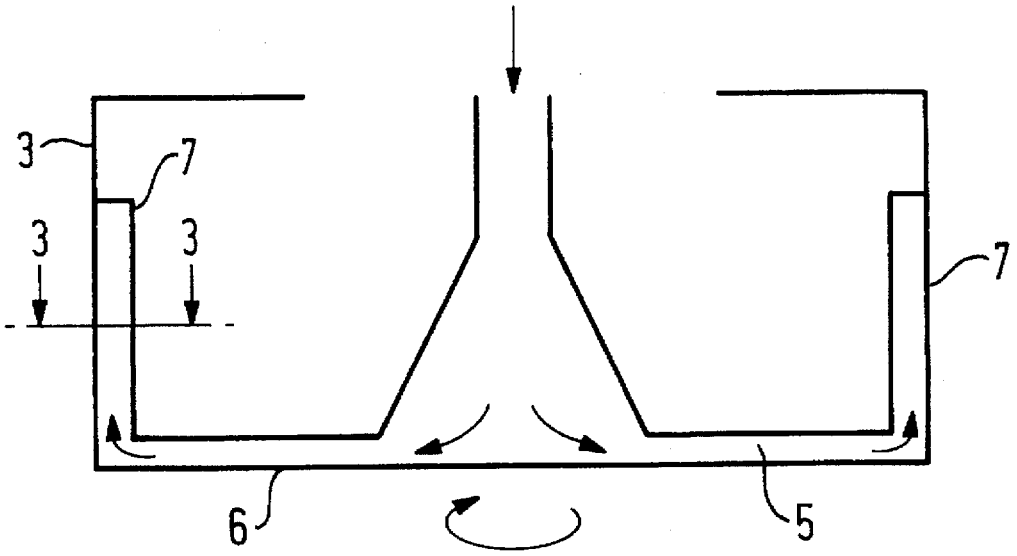
FIG. 2 shows schematically a moulding system according to a first embodiment with individual moulds symmetrically located on the casting table shown in FIG. 1.

With reference now to the mould system of FIG. 2, the molten alloy is caused to flow radially outwards by the centrifugal force created on rotation of the table 3 through distribution channels 5 on the base 6 of the table to fill individual moulds 7 positioned at the periphery of the table 3.

To balance the forces acting on the casting table 3 during rotation, the moulds 7 are symmetrically located around the table 3. Thus, two, three, four or more moulds 7 may conveniently be fed from distribution channels 5 radiating from the centre of the table 3.

Each mould 7 is secured in an upright position to the circumferential wall of the table 3 and is connected at the lower end to the associated distribution channel 5. The centrifugal force created by rotating the table 3 forces the molten alloy along the distribution channel 5 and up the outer surface of the mould 7.

The pressure of metal in the distribution channel 5 causes the mould 7 to fill inwards towards the centre of the table 3 until the mould is completely filled. We have found that the centrifugal force should be at least 20 g and preferably 30 g or even 50 g.

Any residual porosity in the casting tends to be forced inwards towards the part of the mould 7 nearest the centre of the table 3 and can be eliminated by machining away the inner surface of the casting if necessary.

Figure 3:
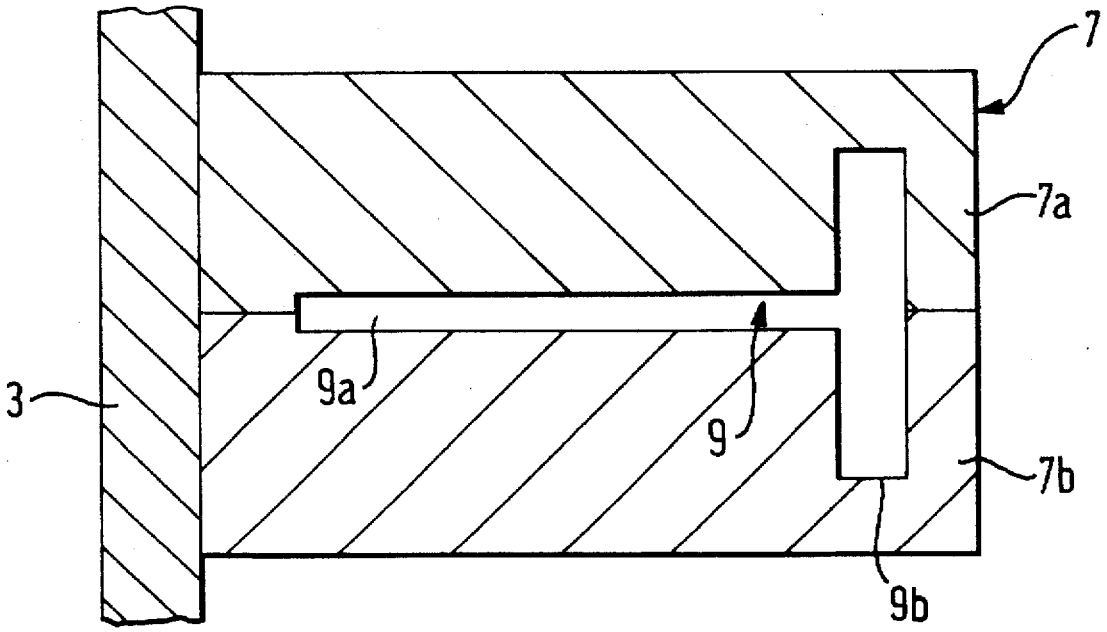
FIG. 3 is a section on the line 3—3 of FIG. 2.
Figure 4:
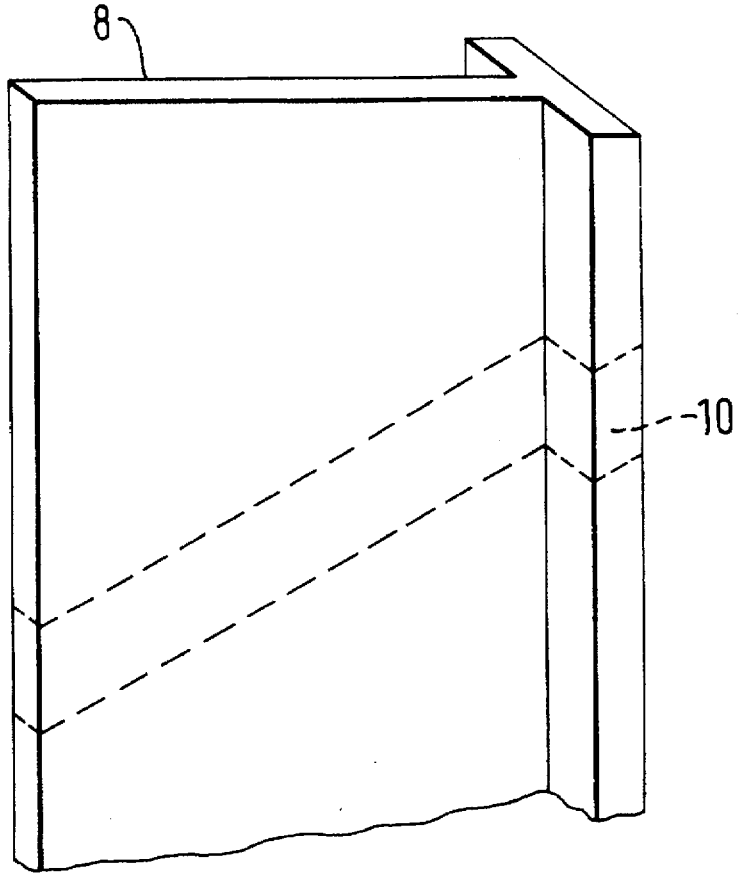
FIG. 4 is a perspective view of the casting produced by the mould system shown in FIGS. 2 and 3.

FIG. 3 shows a mould 7 for casting a T-section blank 8 shown in FIG. 4. The mould 7 comprises two sections *7a,7b* clamped together to define a mould cavity 9 of uniform T-section. The mould 7 is secured to the wall of the casting table 3 with the foot *9a* of the cavity 9 radially outermost but it will be understood the mould 7 could be reversed so that the head *9b* of the cavity 9 is radially outermost.

As shown in outline in FIG. 4, a preform 10 suitable for finish forging to an airfoil (not shown) for an aero-engine or industrial gas turbine is sliced from the T-section blank 8 to give the required angle between the root platform faces and the airfoil section. By casting an elongate section, several preforms 10 can be obtained from a single blank 8 at a lower unit cost as compared with casting individual preforms.

Preforms for different patterns of airfoil can be obtained by casting blanks having different sections. For example, preforms for single ended airfoils with a root block but no shroud may be obtained from a T-section blank or an L-section blank and preforms for double ended airfoils may be obtained from an I-section blank.

Figure 5:
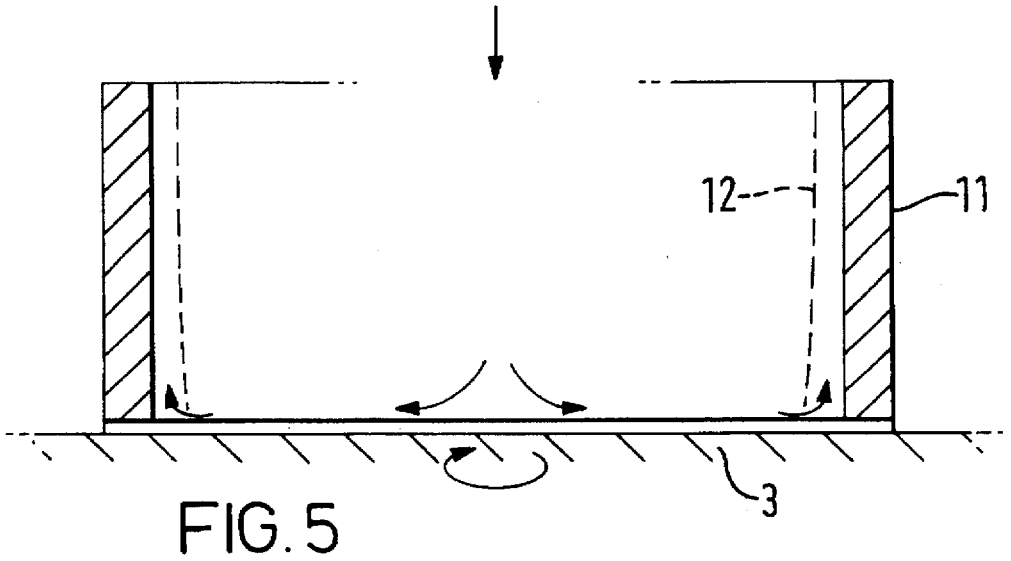
FIG. 5 shows schematically a moulding system according to a second embodiment with a cylindrical mould centred on the casting table shown in FIG. 1.

With reference now to the mould system of FIG. 5, the molten alloy is caused to flow radially outwards by the centrifugal force created on rotation of the table 3 to fill cavities in the wall of a cylindrical mould 11 centred on the table 3 to form a cylindrical blank 12. This system avoids the expense of distribution channels feeding individual moulds and makes maximum use of the circumference of the table.

The molten alloy flows up the wall of the mould 11 filling the cavities with the inner surface of the blank 12 being defined as a surface of equal pressure acting on the molten metal held against the mould wall by the centrifugal force. We have found that the centrifugal force at the inner surface of the mould should be at least 20 g and preferably 30 g or even 50 g.

Any residual porosity in the casting tends to be forced inwards towards the centre of the table 3 by the difference in centrifugal force at the outer and inner surfaces of the casting and can be eliminated by machining away the inner surface of the casting if necessary.

Figure 6:
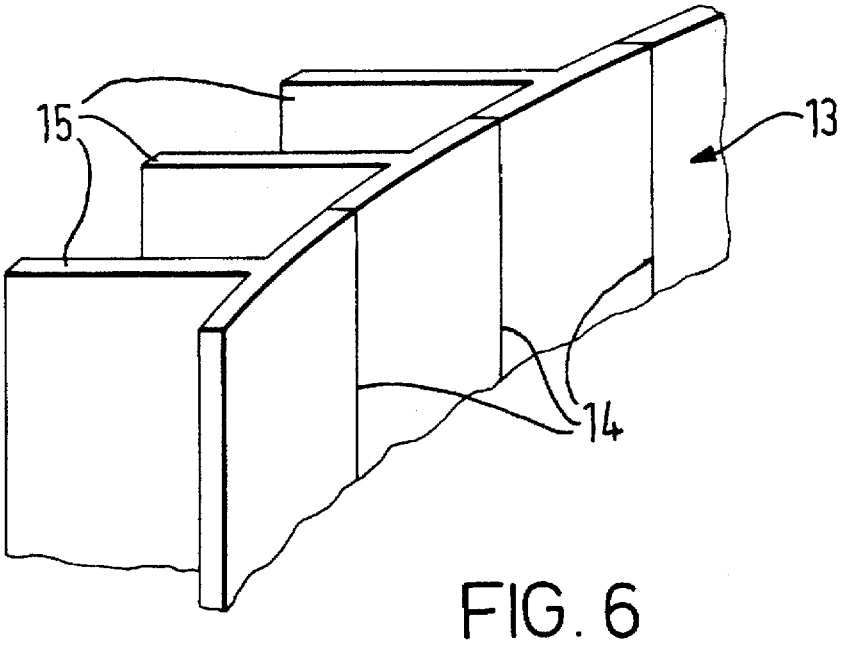
FIG. 6 is a perspective view of part of a casting produced by the mould system shown in FIG. 5.

Cylindrical blanks 12 may be obtained having any desired size and shape for slicing to produce preforms suitable for finish forging. FIG. 6 shows part of a cylindrical blank 13 that is separable by radial cuts 14 to produce a series of elongate blanks 15 of uniform T-section from which individual preforms suitable for finish forging may be cut as described above with reference to FIG. 4.

Figure 7:
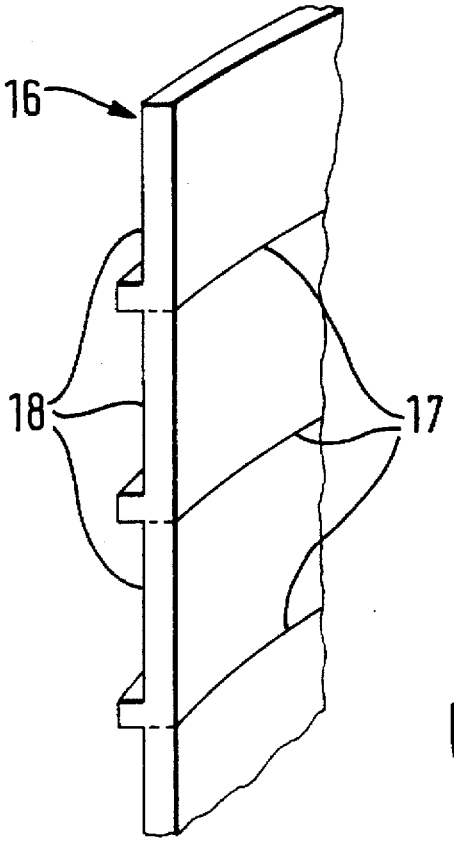
FIG. 7 is a perspective view of part of an alternative casting produced by the mould system shown in FIG. 5.

FIG. 7 shows part of a cylindrical blank 16 that is separable by circumferential cuts 17 to produce a series of annular blanks 18 of uniform L-section from which individual preforms may be cut by radial slicing.

It will be appreciated that the mould systems above-described may be used to produce blanks varying from simple symmetric sections to complex asymmetric sections depending on the shape of the required forging.

Permanent moulds which can be re-used many times to make a multiplicity of castings are preferred to conventional sand or investment moulds which can only be used once and are destroyed in extracting the casting. Such permanent moulds should have a high heat capacity and thermal conductivity to absorb the latent heat of fusion and cool the casting without distorting and should have no reaction with titanium.

Steel moulds are found to produce acceptable castings with no pickup of iron or other contamination from the mould. The results of the analysis of cylindrical rings of Ti-6Al-4V alley, cast in steel moulds are set in Table 1 which includes a comparison with the analysis of standard billets of the same alloy. Other suitable permanent mould materials include block graphite.

TABLE 1

| Sample | Chemical Composition (Weight %) | | | | |
|---|---|---|---|---|---|
| | Al | V | Fe | N | O |
| Standard Billet | 6.61 | 4.14 | 0.17 | 0.0075 | 0.165 |
| | 6.45 | 4.17 | 0.19 | 0.0080 | 0.180 |
| Cast Ring | 6.46 | 4.06 | 0.16 | 0.011 | 0.15 |
| | 6.47 | 4.05 | 0.16 | 0.010 | 0.15 |
| | 6.50 | 4.04 | 0.16 | 0.010 | 0.15 |

Castings obtained by the above described method are found to have a Widmanstatten structure of long needles of $\alpha$ in a $\beta$ matrix with a small uniform grain size and equiaxed grain structure that is amenable to finish forging of preforms produced therefrom. The results of tests on the tensile properties of cast bar of Ti-6Al-4V bar under different conditions are set out in Table 2 which includes a comparison with the tensile properties specified in MSSR 8610.

TABLE 2

| Condition | 0.2% PS MPa | U.T.S. MPa | Elongation % on 5D | R of A % |
|---|---|---|---|---|
| MSSR 8610 | >830 | 930–1160 | >8 | >25 |
| As cast | 863 | 990 | 9 | 21 |
| As cast + 1 hour/700° C. | 880 | 991 | 7 | 13 |
| As cast + 1 hour/960° C. | 823 | 959 | 6 | 13 |
| Forged 25% | 899 | 1005 | 8 | 19 |
| Forged 25% + 1 hour/700° C. | 911 | 1008 | 7 | 19 |
| Forged 25% + 1 hour/960° C. | 841 | 975 | 11 | 28 |
| Forged 50% | 952 | 1038 | 9 | 26 |
| Forged 50% + 1 hour/700° C. | 955 | 1038 | 10 | 27 |
| Forged 50% + 1 hour/960° C. | 862 | 989 | 11 | 32 |

The test results show that, with the exception of ductility, the tensile properties of the 'as cast' bar achieve the levels specified in MSSR 8610. Subsequent heat treatment of the 'as cast' bar does not improve the tensile properties.

The tensile properties are improved and the levels specified in MSSR 8610 achieved by a 50% forging reduction of the 'as cast' bar. Subsequent heat treatment of the 'forged' bar has little effect at 700° C. but 1 hour at 960° C. further homogenises the structure and improves the ductility, even after only a 25% forging reduction.

The room temperature stress-rupture life (at stress of 1172 MPa) of both the 'as cast' bar and 'forged' bar heat treated for 1 hour at 700° C. exceeds the minimum specified in AMS 4928. Similarly, Charpy impact properties of both the 'as cast' and 'forged' bar matches or exceeds the minimum requirements whether or not the bar has been given a subsequent heat treatment at 700° C. or 960° C.

These results show that preforms obtained from castings as above-described can be designed so as to achieve controlled reductions in different areas of the preform during finish forging to obtain the desired properties. In particular, it is possible for the shape of the airfoil section of a cast preform to be much closer to the shape of the forged airfoil without the need to forge to an intermediate shape.

For example, we have found that a cast preform with a thin rectangular section can readily by forged with an 80% reduction into the airfoil section of the blade. However, in contrast to conventional forging from hot worked preforms of circular or elliptical cross-section in which the metal must be flowed across the die face to achieve the flatter section of the forged airfoil, the metal flow of the 'closer to forged shape' cast preform is markedly different with very little metal flow across most of the airfoil die face. This reduces die wear, but makes the forged airfoil surface finish more dependent on the surface finish of the preform. Accordingly, to achieve the best forged surface finish, it is preferable to grind, linish or etch the flat surface of the cast preform.

The tensile properties of test pieces machined from the root block region of a small compressor blade forged from a cast preform of Ti-6Al-4V alloy designed to ensure at least 50% reduction in the root block on forging are set out in Table 3 which includes a comparison with the tensile properties specified in MSSR 8610 and the tensile properties of the cast preform.

TABLE 3

| Condition | 0.2% PS MPa | U.T.S. MPa | Elongation % on 5D | R of A % |
|---|---|---|---|---|
| MSSR 8610 | >830 | 930–1160 | >8 | >25 |
| Cast preform | 947 | 1065 | 5 | 18 |
| Forged blade (50%) | 1113 | 1179 | 11 | 32 |
| Forged blade (50%) + 1 hour/700° C. | 1102 | 1157 | 8 | 29 |
| Forged blade (50%) + 1 hour/960° C. + 1 hour/700° C. | 1012 | 1088 | 10 | 24 |

The test results show that the tensile properties of the cast preform are improved by forging and meet the levels specified in MSSR 8610 and are not further improved by subsequent heat treatment.

To assess stiffness of the blades forged from the cast preforms, Young's modulus was measured and the results set out in Table 4 which includes a comparison with blades forged from preforms of the same alloy produced from rolled bar by conventional hot working and the cast preform.

TABLE 4

| Condition | Youngs Modulus (GPa) |
|---|---|
| Blade forged from rolled bar | 102–130 |
| Cast preform | 119–128 |
| Blade forged from cast preform | 127 |
| Blade forged from cast preform + 1 hour/700° C. | 128 |
| Blade forged from cast preform + 1 hour/960° C. + 1 hour/700° C. | 130 |

The results show no significant difference in stiffness between blades obtained from hot worked preforms by the conventional route and blades obtained from cast preforms produced in accordance with the invention.

As will be appreciated from the foregoing description, the present invention provides a method of manufacturing a metallic component such as an airfoil for the compressor of an aero engine or industrial gas turbine by employing centrifugal casting as a route to a preform having a required configuration for forging to the desired shape of the component. The blank may provide a single pre-form having the required configuration but more preferably the blank is separable into a plurality of preforms having the required configuration. Forming several pre-forms from one blank simplifies manufacture and enables re-usable moulds to be used with resultant savings in the unit cost of the pre-forms compared with casting blanks for individual preforms.

Finally, although the invention has been described with reference to the production of cast preforms in titanium alloy, it will be apparent and readily understood by those skilled in the art that the same benefits and advantages can be achieved for the production of metallic components from cast preforms in other metals and alloys. For example, cast preforms for forging to finished components in alloys of nickel or iron may be employed and are deemed within the scope of the invention.

We claim:

1. A method of manufacturing a forged metallic component comprising the steps of rotating casting means about an axis of rotation to generate a centrifugal casting force, feeding molten alloy to said rotating casting means for casting a plurality of elongate rectilinear blanks extending substantially parallel to and radially spaced from said axis of rotation, separating each of said blanks into a plurality of preforms having a required configuration for forging to a desired component, and forging each of said preforms to produce said component.

2. A method according to claim 1 wherein said centrifugal casting force is at least 20 g.

3. A method according to claim 1 wherein each of said blanks has a uniform section.

4. A method according to claim 3 wherein each of said blanks has a T-, L- or I-section.

5. A method according to claim 3 wherein each of said blanks has a circular section.

6. A method according to claim 1 wherein the step of forging reduces the cross-section of said preform by at least 50%.

7. A method according to claim 1 further comprising the step of heat treating said forged component.

8. A method according to claim 1 wherein each of said blanks is separable to provide a plurality of substantially identical preforms having the required configuration.

9. A method according to claim 1 wherein said centrifugal casting force is at least 30 g.

10. A method according to claim 1 wherein said centrifugal casting force is at least 50 g.

11. A method according to claim 1 further comprising the step of casting said blanks under pressure in a vacuum with low superheat.

12. A method according to claim 1 further comprising the step of casting said blanks in a plurality of moulds radially spaced from and circumferentially spaced around said axis of rotation.

13. A method according to claim 12 wherein each of said moulds comprises a material having high heat capacity and thermal conductivity.

14. A method according to claim 13 wherein each of said moulds comprises a material selected from the group consisting of steel and block graphite.

15. A method according to claim 12 wherein said moulds are arranged symmetrically about said axis of rotation.

16. A method according to claim 12 wherein each of said moulds is arranged to fill in a direction towards said axis of rotation.

17. A method according to claim 1 further comprising the step of casting an integrated multiple blank and longitudinally separating said multiple blank to form said plurality of blanks.

18. A method according to claim 1 further comprising the step of separating each of said blanks into said preforms at an oblique angle to the longitudinal axis of said plurality of blanks.

19. A method according to claim 1 wherein said alloy is selected from the group consisting of titanium, nickel and iron.

20. A method according to claim 1 wherein said forged metallic component is selected from the group consisting of an airfoil, a medical prosthesis and a pipe fitting.

* * * * *